United States Patent [19]

Fryer

[11] Patent Number: 4,538,995

[45] Date of Patent: Sep. 3, 1985

[54] PORTABLE COMPUTER CLASSROOM

[76] Inventor: Alan Fryer, P.O. Box 817, Ceres, Calif. 95307

[21] Appl. No.: 621,114

[22] Filed: Jun. 15, 1984

[51] Int. Cl.[3] ..... A47B 19/41; B62D 39/00

[52] U.S. Cl. ..... 434/432; 296/24 R

[58] Field of Search ..... 52/79.1; 296/1 R, 24 R; 434/432

[56] References Cited

U.S. PATENT DOCUMENTS 2,817,846 12/1957 Stift ..... 296/24 R X 3,694,023 9/1972 Burgess ..... 296/24 R 4,449,746 5/1984 Clark ..... 296/24 R X

*Primary Examiner*—Harland S. Skogquist

*Attorney, Agent, or Firm*—Mark C. Jacobs

[57] ABSTRACT

A portable easily transportable computer classroom having a plurality of separate areas, each area having a pair of computer desks and electrical outlets for providing lighting, heat, air conditioning and powering the computers installed at the desks when hooked up to a remote source of electricity, such as a school site. The classroom can thus be used by a school not having resources or space to afford the computer equipment or a separate computer classroom.

9 Claims, 5 Drawing Figures

PORTABLE COMPUTER CLASSROOM

BACKGROUND OF THE INVENTION

1. Field of the Invention

The invention relates to portable classrooms; and, more particularly, to a computer classroom that can be quickly and easily hooked up to a truck and transported to a remote location, such as a school site.

2. Description of the Prior Art

There has been quite a bit of interest in recent years in the exploding computer technology. Many people believe that children must be taught the use of computers in the classroom or they will lag behind others in such knowledge. However, not every school can afford the equipment necessary or the space required for a permanent computer classroom. Although computer equipment can be leased, it is quite cumbersome to drag such equipment in and out of school sites and, of course, it is still necessary to provide a separate classroom or area. Buses are impractical since they break down and the equipment installed on the buses is out of action as long as the buses are down.

There is thus a need for a portable computer classroom that can be used by a school not having the resources to buy its own equipment or the space to set up such equipment permanently.

SUMMARY OF THE INVENTION

It is an object of the invention to provide a portable computer classroom.

It is a further object of this invention to provide a computer classroom that includes computer desks in separate areas and can be quickly and easily transported from one location to another.

It is still further an object of this invention to provide a computer classroom that includes equipment for providing heat, electricity and power for the computer equipment when it is hooked up to a source of electricity.

It is another object of this invention to provide a portable computer classroom that is independent of the means for transporting it.

These and other objects are preferably accomplished by providing a trailer having a plurality of separate areas, each area having a pair of computer desks and electrical outlets for providing power to the computers installed at the desks when hooked up to a remote source of electricity, such as a school site. The classroom is self-contained and includes lighting, heat and air conditioning and can thus be used by a school not having resources or space to afford the computer equipment or a separate classroom and can be shared with one or more other schools.

DESCRIPTION OF THE PREFERRED EMBODIMENT

Figure 1:
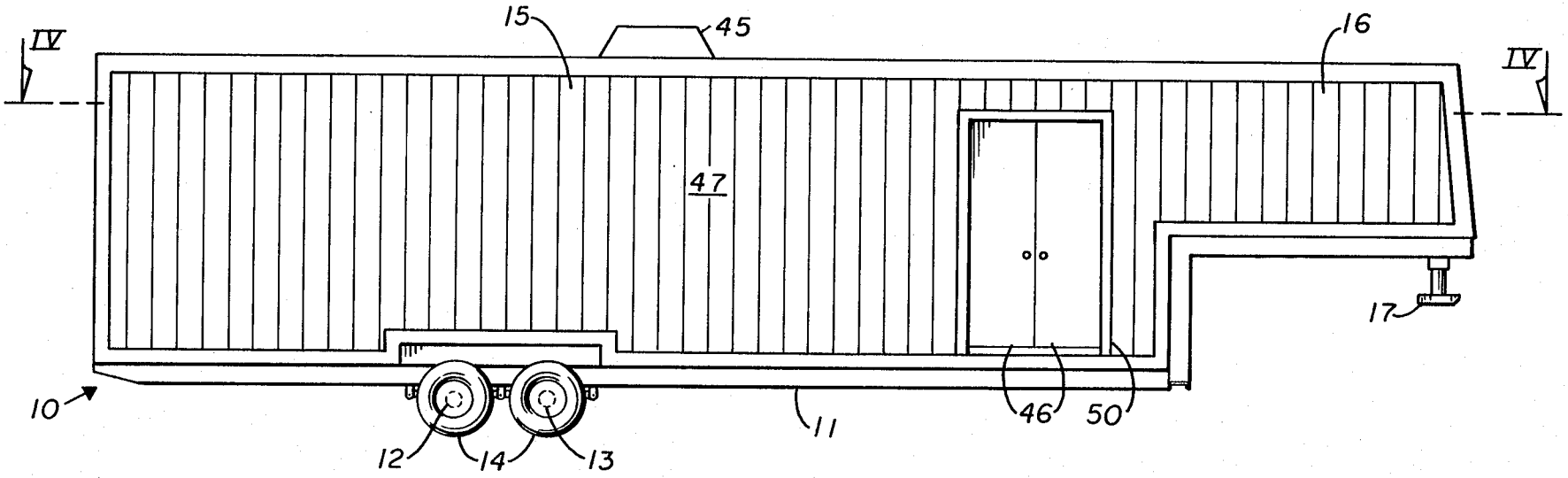
FIG. 1 is a vertical view of a portable classroom in accordance with the invention.

Referring now to FIG. 1 of the drawing, a portable computer classroom 10 is shown mounted on a flat bed 11 having spaced axles 12,13 with wheels 14 mounted thereon. Of course, any suitable number of axles and wheels mounted thereon may be provided depending on the dimensions of the classroom 10.

Classroom 10 includes a main body portion 15 and a front overhang portion 16. As particularly seen in FIG. 2, portion 16 hangs or protrudes over a space or area adapted to receive the bed of a trailer truck (not shown) therein, the downwardly protruding connector 17 being adapted to engage a mating socket on the bed of the trailer truck so that classroom 10 can be towed by the truck as is well known in the art. The arrangement herein in FIG. 1 is commonly known as a fifth wheel or fifth wheeler although any suitable towing arrangement may be provided. Also, the body need not be a fifth wheeler body but can be any towable trailer body.

Figure 2:
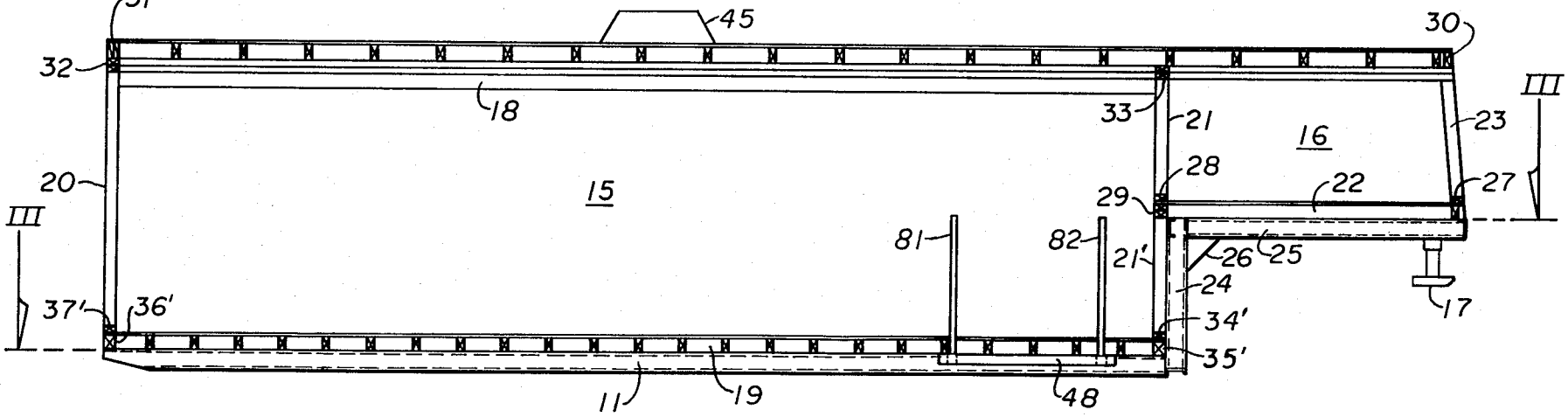
FIG. 2 is a vertical sectional view of the framework alone of the portable classroom of FIG. 1.

As seen in FIG. 2, the framework for classroom 10 includes an upper ceiling structure 18 and a lower floor structure 19. Floor structure 19 is secured to flat bed 11 in any suitable manner. Main body portion 15 is framed off at the rear by wall studs 20 and at the front by wall studs 21. A sub-flooring 22 extends from stud 21 (connected to cross beams 27,28 and 29, as shown, in any suitable manner) and a stud 23 coupled to beams 30 is provided at the front of overhang portion 16. Stud 23 may deviate slightly from the vertical, such as rearwardly, e.g., about 6 inches, to provide an aerodynamic surface. Flanges 24,25, coupled to studs 21 and sub-flooring 22, respectively, may be provided for added support with a gusset 26 interconnecting the flanges 24,25 at their intersection.

Both ceiling structure 18 and floor structure 19 may be honey-combed structures as shown for insulation. It is to be understood that suitable internal joists and beams are provided for assembly of the various walls, studs, and structures to arrive at the framework shown in FIG. 2. This Figure shows the ceiling structure 18 connected at the front to beam 30 and at the rear to beams 31,32. Intermediate cross beams 33 couple ceiling structure 18 to studs 21. The bottom studs 21' are coupled to beams 29 and 34', as shown. Floor structure 19 is also coupled at the front to beams 35' and at the rear to beams 36',37' (with studs 20 interconnected between beams 37' and 32). Of course, any number and type of beams, joists and studs may be used to arrive at the structure shown in FIG. 2 and similar structure is on the side of the framework not visible in FIG. 2.

The structure in FIG. 2 may have any suitable dimensions, such as six feet in width and 41 feet in overall length.

Figure 3:
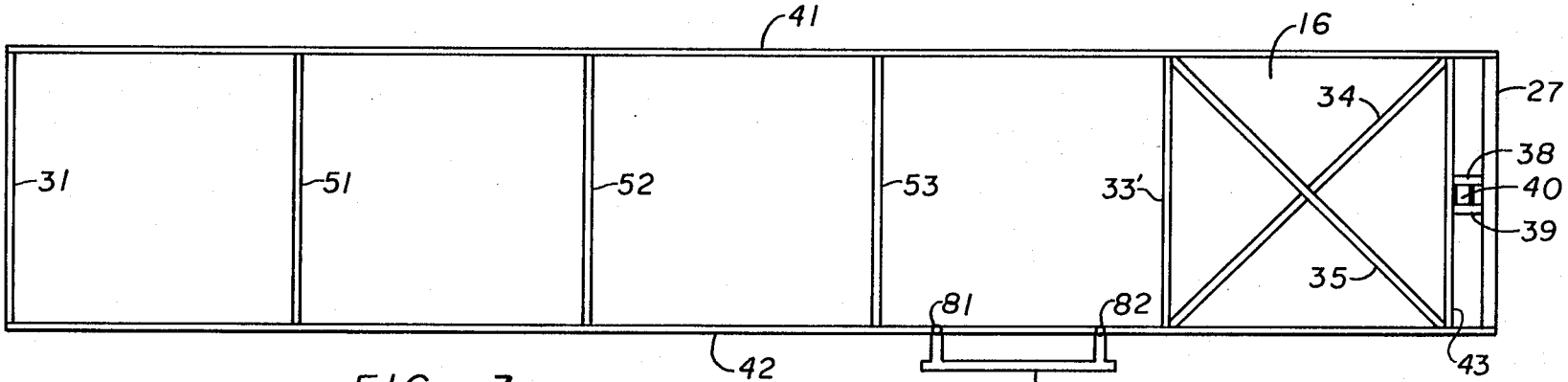
FIG. 3 is a plan view of the framework of FIG. 2 taken along lines III—III thereof (at the level of the ceiling)

As seen in FIG. 3, overhang portion 16 may be additionally reinforced by cross-braces 34,35 secured to cross-beams 33',30. Lower cross-beam 27 is further secured to beam 30 by support members 38,39 on each side of vertical support 40. Main supports 41,42 extend along the bottom of classroom 10 joined at cross-beam 31 at the rear and cross-beams 33',27 at the front. Of course, again any suitable framing structure may be used and similar cross-beams are provided at the floor of classroom 10. Thus, all framework merely serves to support the side panelling to arrive at the classroom shown in FIGS. 1 and 4. Cross-members 51–53 may be provided between supports 41 and 42 to provide lateral support.

The classroom 10 may have any suitable internal dimensions, such as an internal height of about 7 feet, 6 inches. As seen in FIG. 1, an air conditioning unit 45 may be mounted on the roof venting into the interior of classroom 10 and double doors 46 mounted in door jamb 50 may be provided in side wall 47.

As seen in FIGS. 2 and 3, a lift 48 may be mounted in classroom 10 movable up vertical posts 81,82 (FIG. 2) for a wheel chair or the like. Such lift 48 is of conventional wheelchair lifting equipment, such as a standard lift gate, well known in the art and further discussion is deemed unnecessary. Of course, suitable electronic controls of such a lift may be provided and double doors 46 in FIG. 1 may open outwardly from the middle thereof to provide a suitable opening for a wheel chair.

Figure 4:
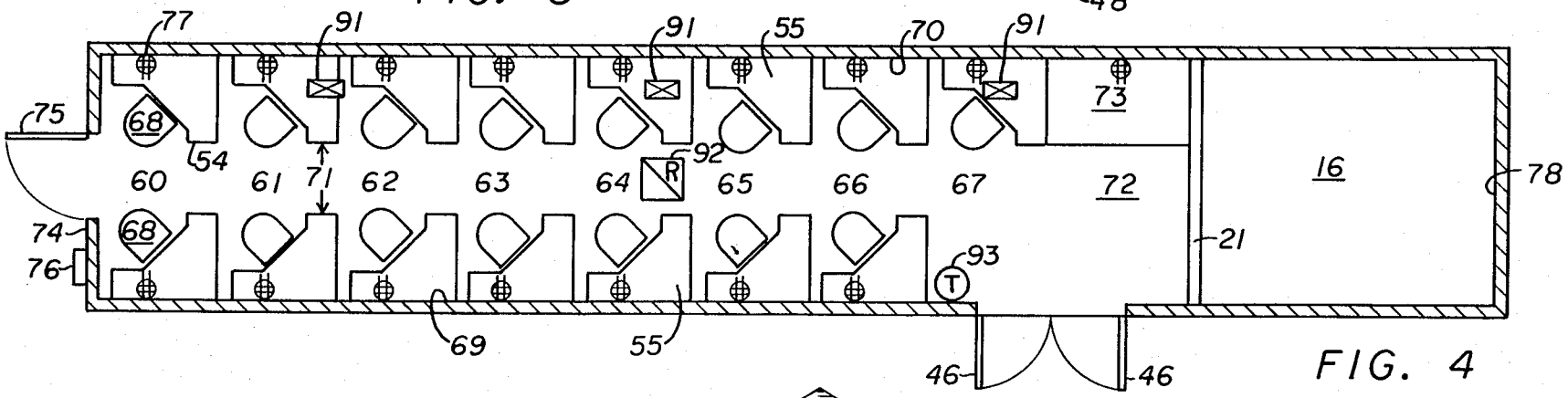
FIG. 4 is a view of the classroom of FIG. 1 taken along the lines IV—IV thereof at the junction of the wooden upper structure and steel supporting structure.

FIG. 4 is a view similar to FIG. 3 showing the internal layout of the equipment therein after walls or panelling are mounted on the framework of FIGS. 2 and 3 as seen in FIG. 1. Overhang portion 16 may be used for storage and double doors 46 swing outwardly.

Figure 5:
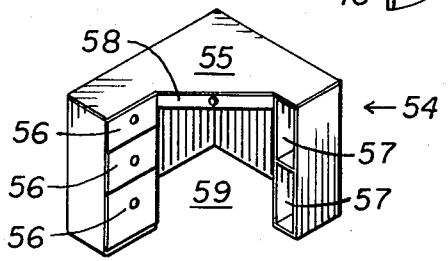
FIG. 5 is a perspective view of one of the desk units of the classroom of FIGS. 1 through 4.

As seen in FIG. 5, individual modular or desk units 54 are provided, each unit having an upper wedge-shaped work surface 55, drawers 56,58, shelves 57 and a space 59 underneath the middle of work surface 55. Of course, desk unit 54 can take a variety of configurations and may include a variety of built-in areas, storage spaces, etc. and need not include any drawers, if desired. Preferably, the units are corner units as shown for reasons to be discussed and are adapted to have suitable computer equipment placed on the surface 55.

As seen in FIG. 4, a pair of desks or units 54 are located in separate areas of the classroom 10. Thus, areas 60 through 66 are provided with a pair of desk units 54 in each area as shown. These units are disposed such that pupils sitting on chairs 68 (only shown in area 60) face their respective desk unit 54 with one linear extent of the unit 54 running along the respective front or back wall, i.e., walls 69,70, respectively, and have their linear back portions extending normal to walls 69,70 thus forming in effect separations or partitions between areas 60–67 with access openings or aisles formed by the space 71 (shown in area 60) between each desk unit 54. Only one desk unit 54 is shown in area 67 because of the location of the door opening for doors 46. Area 72 between area 67 and storage area 16 may be provided with a table 73 for use by a handicapped pupil.

Wall panelling 78 closes off the front and panelling 74 closes off the rear with a rear door 75 provided therein. Of course, the various wall panelling 69,70, 78 and 74 is mounted to the framework of FIGS. 2 and 3 in any suitable manner.

Lights, such as a recessed fluorescent lights mounted in the ceiling may be provided. Also, electrical outlets, a thermostat control, air diffusers, etc. may all be provided as is well known in the art. Various materials may be used, such as plywood for the floors, tack board over plywood for the interior, insulation in the roof, walls and floor, etc. Formica may be used for the work surfaces 55 and the floor may be carpeted with suitable carpeting, such as static free carpeting. Of course, suitable storage shelves may be mounted in the interior of classroom 10 where desired. Tack boards may be mounted on the interior walls, if desired.

Materials that cut down on noise are preferably used throughout. Any suitable dimensions may be used. For example, space 71 may be about 2'6" wide. An electrical panel 76 is mounted on rear wall 74 for hook up to an external source of electricity. Although chairs 68 are shown, the chairs may be provided by the school. Grounded outlets 77, such as 3 or 4 plug outlets, are provided at each desk unit 54 coupled to panel 76.

The desk units 54 may be conventional wedge-shaped units, such as about 26" to 30" high, or custom computer desks and may have stands mounted thereon for printers, paper storage, monitors, etc. Suitable means such as tie straps, may be provided for holding the internal movable components, such as chairs, desk units, etc. during towing.

Suitable levelers known in the art may be provided for leveling the classroom when it is removed from the truck and set up for classroom use.

The air system includes the unit 45 and suitable interconnected ducts opening into one or more areas 60–67 and 72.

The unit 10 may or may not be provided with the lift gate 48. Such a gate could be supplied by the schools and easily mounted on supports 81 and 82.

It can be seen that there is described a self-contained classroom that can be quickly and easily towed from one location to another, quickly set up and hooked up to a power supply. It can be moved from one school to another so that the schools can share the costs and it is better than a bus since it can be used if the truck breaks down and must be repaired.

Thus, the portable computer classroom is quite versatile and can be used by schools not having room for a permanent classroom or able to afford such equipment. To further enhance the classroom of this invention, one may incorporate air diffusers such as 91, air returns, 92 which lead to air conditioning equipment 45, and a thermostat 93, all of which are shown in FIG. 4.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A self-contained portable computer classroom comprising:

a trailer body mounted on wheels having connecting means at one end for connecting the body to a truck for towing by the truck;

at least one access door opening into the interior of said body, the interior of said body being open throughout but divided into a plurality of separate classroom areas and having a floor, a ceiling and longitudinally extending spaced inner side walls closed off at each end thereof by end walls;

at least two adjacent classroom areas being formed by a plurality of desk units, two of said desk units being provided in one area and two of said desk units being provided in an adjacent abutting area; and each of said units having an upper flat working surface and being wedge-shaped having a first straight line portion running along one of the inner side walls of said body in one of said areas and a second straight line portion extending both to the first straight line portion and to the plane of said inner wall, said two of said desk units disposed in one of said areas being disposed against opposite inner side walls of said body, the second straight line portions of said two of said desk units being spaced from each other thereby forming an aisle along the central longitudinal axis of said body.

2. In the classroom of claim 1 wherein said two of said desk units in said adjacent abutting areas are oriented identically with respect to the two of said desk units in its adjacent abutting area so that the intersection of the first and second straight line portions of each adjacent desk unit along one of the inner side walls are remote from each other.

3. In the classroom of claim 1 wherein a side door is provided opening into said body at the end thereof remote from the end of said body having said connecting means thereon.

4. In the classroom of claim 1 wherein said access door are double doors and wheel chair lift means is provided at said double door for lifting a wheel chair into the interior of said body.

5. In the classroom of claim 1 wherein a storage area is provided at the end of said body having said connecting means thereon.

6. In the classroom of claim 5 wherein said body is a fifth wheeler trailer body having an overhang at the end thereof where said connecting means is located, said overhang being adapted to overhang on to the bed of a trailer truck for connection thereto, the interior of said overhange providing said storage area.

7. In the classroom of claim 1 including an air conditioning unit mounted on the roof of said body venting into the interior thereof.

8. In the classroom of claim 1 including a plurality of electrical outlets mounted in each of said classroom areas, all of said outlets being coupled to an electric panel on said body adapted to be connected to a remote electrical source.

9. In the classroom of claim 1 wherein the walls, floor and ceiling of said body is insulated.

* * * * *